US007032276B1

(12) United States Patent
Olson

(10) Patent No.: US 7,032,276 B1
(45) Date of Patent: Apr. 25, 2006

(54) ADJUSTABLE SNAP BUCKLE

(76) Inventor: Casey Olson, 930B Morgan St., Santa Rosa, CA (US) 95401

( * ) Notice: Subject to any disclaimer, the term of this patent is extended or adjusted under 35 U.S.C. 154(b) by 280 days.

(21) Appl. No.: 10/462,963

(22) Filed: Jun. 17, 2003

(51) Int. Cl.
*A44B 11/10* (2006.01)

(52) U.S. Cl. ..... 24/171; 24/115 G; 24/136 R; 24/183

(58) Field of Classification Search ..... 24/309, 24/310, 312, 378.1, 682.1, 683–686, DIG. 43–DIG. 49, 24/DIG. 51, 166–168, 171, 182, 712.5, 712.7, 24/712.8, 712.9, 713.2, 136 R, 136 L, 115 G, 24/115 H, 578.1, 578.13, 578.14, 578.15, 24/578.17, 582.1, 592.1, 593.1, 34, 68 E, 24/460, 91, 302, 115 R, 165, 697.2; 190/119–121; 383/78–79; 292/288; 224/235–237; 150/108, 150/118, 119
See application file for complete search history.

(56) References Cited

U.S. PATENT DOCUMENTS 613,492 A * 11/1898 Buxton ..... 190/119
1,190,014 A * 7/1916 Sampson ..... 24/684
2,160,368 A * 5/1939 Monesson ..... 2/321
2,314,246 A * 3/1943 Ritter ..... 24/163 R
3,372,440 A * 3/1968 Burson, Jr ..... 24/310
3,604,069 A * 9/1971 Jensen ..... 24/332
4,393,550 A * 7/1983 Yang et al. ..... 24/712.5
4,811,466 A * 3/1989 Zubli ..... 24/115 G
5,184,798 A 2/1993 Wilson
5,337,458 A 8/1994 Fukutomi et al.
5,611,118 A 3/1997 Bibbee
6,327,751 B1 12/2001 Ikeda
6,339,865 B1 * 1/2002 Takahashi et al. ..... 24/136 R
6,510,627 B1 1/2003 Liu

* cited by examiner

*Primary Examiner*—Jack W. Lavinder
(74) *Attorney, Agent, or Firm*—Jack Lo

(57) ABSTRACT

An adjustable strap buckle is comprised of a barrel member detachably positioned in a hook member. The barrel member is comprised of a tubular housing with a spring loaded push button projecting from an open end. A button hole is positioned through the button, and housing holes are positioned through opposite walls in the housing. A strap is positioned through all the holes. When the button is released, the button hole is misaligned with the housing holes to bind the strap. When the button is pressed, the holes are all aligned for releasing the strap for sliding. The hook member is comprised of spaced apart hooks attached to an anchor member for attaching to clothing, a bag, luggage, etc. The barrel member is transversely positioned inside the hooks to secure the strap, wherein the segment of the strap extending from the barrel member is also positioned between the hooks.

8 Claims, 4 Drawing Sheets

ADJUSTABLE SNAP BUCKLE

BACKGROUND OF THE INVENTION

1. Field of the Invention

The invention broadly relates to strap buckles.

2. Prior Art

A typical buckle for a flat strap is comprised of a male member and a female member attached to separate segments of a strap. The male and female members are arranged to be connected together for connecting the strap. The male member includes prongs for mating with a slot in the female member. One or both members may include a slide buckle for adjusting the length of the strap segment, which is bound inside the slide buckle by being positioned along a tightly curved path through the buckle. The tightness of the bind prevents the strap from sliding, but makes adjusting the length of the strap difficult.

A typical buckle for a round cord is comprised of a hollow cylinder with a button movably positioned inside. The button is biased outwardly by an internal spring. A hole in the button is misaligned with holes in the cylinder when the button is released, so that a cord positioned through the holes is bound by the buckle. The cord is freed for sliding through the cylinder when the button is depressed to align the holes. The push button on the round cord buckle makes adjusting the length of the cord very easy, but such a buckle cannot connect separate segments of a cord together.

BRIEF SUMMARY OF THE INVENTION

Objects of the present adjustable strap buckle are to detachably connect a segment of a strap to another segment of the strap, another strap, or another member; and to enable the length of the strap to be easily adjusted.

The present adjustable strap buckle is comprised of a barrel member detachably positioned in a hook member. The barrel member is comprised of a tubular housing with a push button projecting from an open end. The button is biased outwardly by a spring. A button hole is positioned through the button, and housing holes are positioned through opposite walls in the housing. A strap is positioned through all the holes. When the button is released, the button hole is misaligned with the housing holes to bind the strap. When the button is pressed, the holes are all aligned for releasing the strap for sliding. The hook member is comprised of spaced apart hooks attached to an anchor member for attaching to clothing, a bag, luggage, etc. The barrel member is transversely positioned inside the hooks to secure the strap, wherein the segment of the strap extending from the barrel member is also positioned between the hooks.

DETAILED DESCRIPTION OF THE INVENTION

Figure 1:
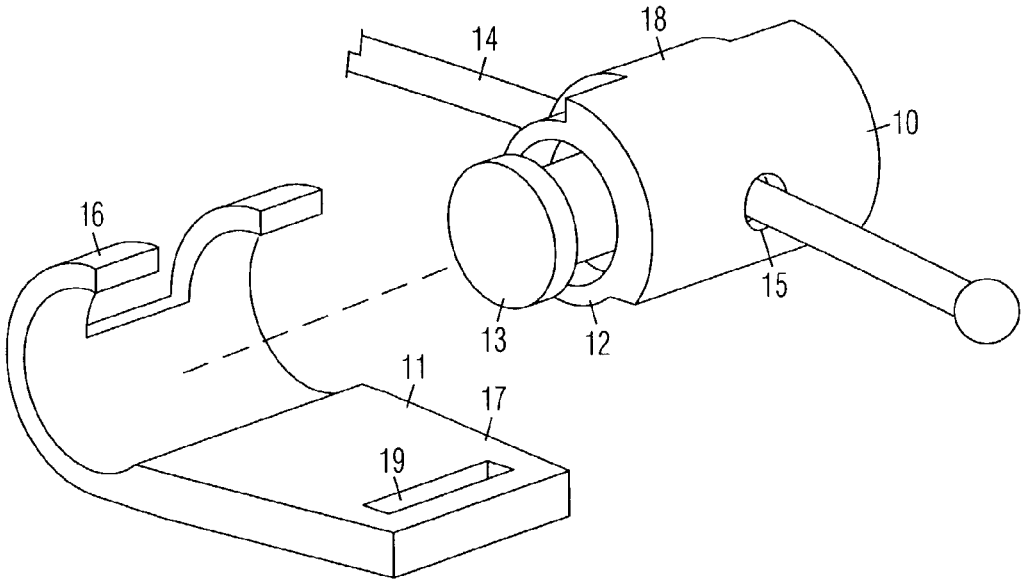
FIG. 1 is a perspective view of the strap buckle when a barrel member and a hook member thereof are disconnected.

FIGS. 1–3:

An adjustable strap buckle shown in FIG. 1 is comprised of a barrel member 10 for detachably positioning in a hook member 11. Barrel member 10 is comprised of a tubular housing 12 with a push button 13 projecting from an open end. In this example, tubular housing 12 is cylindrical. A strap 14 is positioned through housing holes 15 (one shown) on opposite sides of housing 12. In this example, strap 14 is comprised of a round cord.

Hook member 11 is comprised of side-by-side hooks 16 attached to an anchor member 17. In this example, hooks 16 are curved. A key 18 on the outer surface of housing 12 aligns barrel member 10 in hook member 11 to prevent sliding or rotation. Key 18 is preferably T-shaped as shown, wherein the vertical segment of the "T" is for being positioned between hooks 16, and the transverse segment is for being positioned against the ends of hooks 16. A hole 19 in anchor member 17 enables attachment to another end of strap 14, another strap, clothing, a bag, luggage, etc. Hole 19 may be of any shape.

Figure 2:
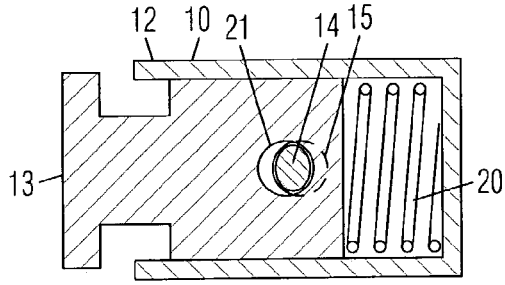
FIG. 2 is a sectional view of the barrel member thereof.

As shown in the sectional view in FIG. 2, button 13 is biased outwardly by a spring 20 inside housing 12. Strap 14 is positioned through housing holes 15 (one shown) in housing and a button hole 21 in button 13. When button 13 is released as shown, button hole 21 is misaligned with housing holes 15 to bind strap 14. When button 13 is pressed, holes 15 and 21 are all aligned to release strap 14 for sliding through barrel member 10 for adjusting its length.

Figure 3:
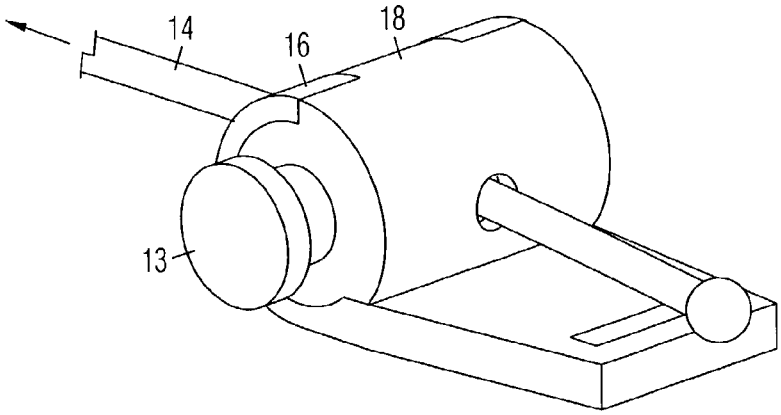
FIG. 3 is a perspective view thereof when connected together.

Barrel member 10 is shown connected to hook member 11 in FIG. 3, wherein barrel 10 is transversely positioned inside hooks 16 to secure strap 14, wherein the segment of strap 14 extending from barrel member 10 is positioned between hooks 16. The vertical segment of T-shaped key is positioned between hooks 16, and the transverse segment is positioned against the ends of hooks 16. Barrel member 10 is prevented from sliding or rotating. The strap buckle is oriented such that tension in strap 14, as indicated by the arrow, is directed away from the open ends of hooks 16 to maintain barrel member 10 inside hook member 11.

Figure 4:
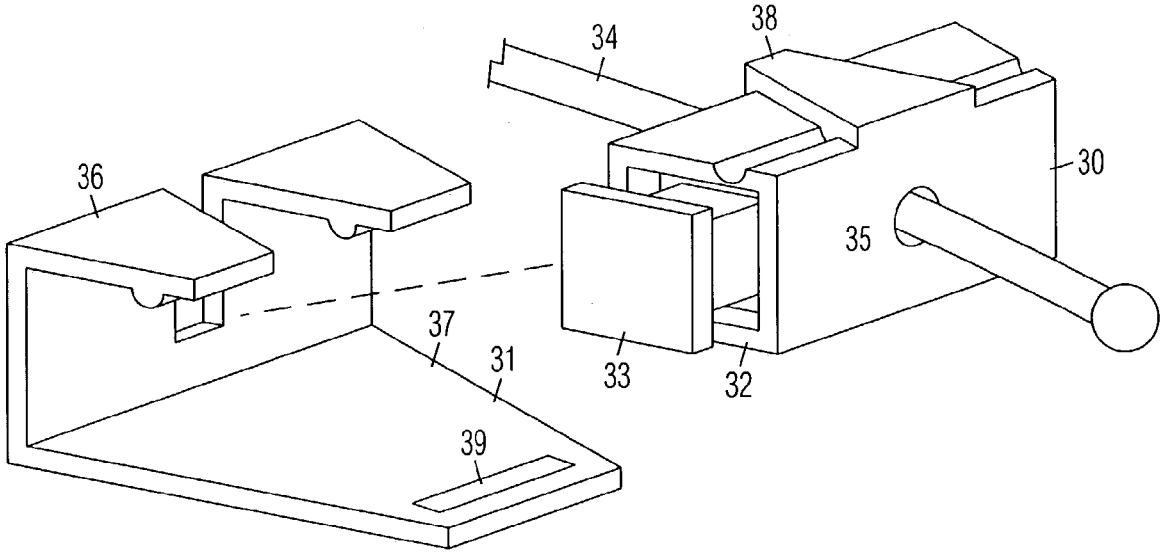
FIG. 4 is a perspective view of a second embodiment thereof when disconnected.
Figure 5:
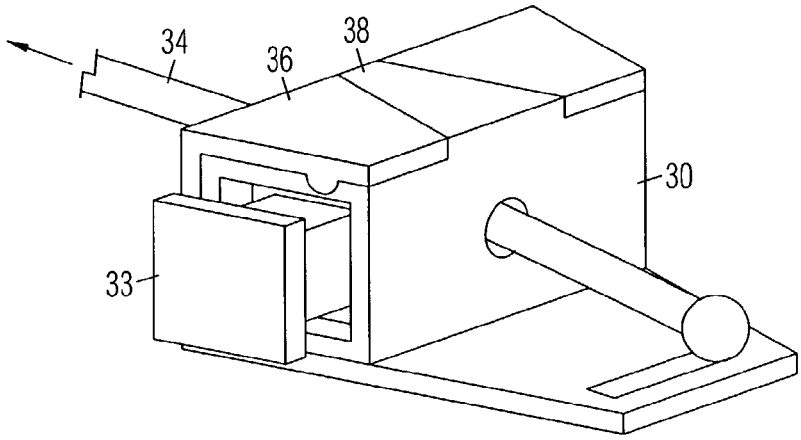
FIG. 5 is a perspective view of the embodiment of FIG. 4 when connected together.

FIGS. 4–5:

A second embodiment of the adjustable strap buckle shown in FIGS. 4–5 is comprised of a barrel member 30 for detachably positioning in a hook member 31. Barrel member 30 is comprised of a tubular housing 32 with a push button 33 projecting from an open end. In this example, barrel member is rectangular in cross section. A strap 34 is positioned through housing holes 35 (one shown) on opposite sides of housing 32. In this example, strap 34 is comprised of a round cord.

Hook member 31 is comprised of side-by-side hooks 36 attached to an anchor member 37. In this example, hooks 36 are comprised of angular brackets. A key 38 on the outer surface of housing 32 aligns barrel member 30 inside hooks 36 to prevent sliding. Key 38 is comprised of a plate with converging sides for facilitating sliding between hooks 36. A hole 39 in anchor member 37 enables attachment to another end of strap, another strap, clothing, a bag, luggage, etc. Hole may be of any shape. Button 33 includes a button hole (not shown) and is biased by an internal spring (not shown) similar to those shown in FIG. 2.

Figure 6:
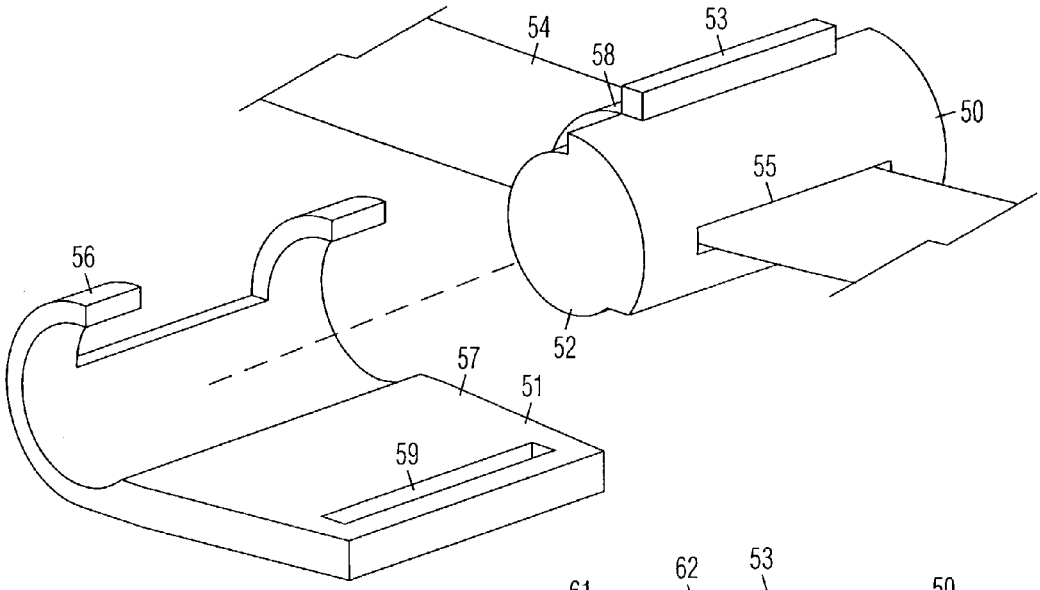
FIG. 6 is a perspective view of a third embodiment thereof when disconnected.
Figure 7:
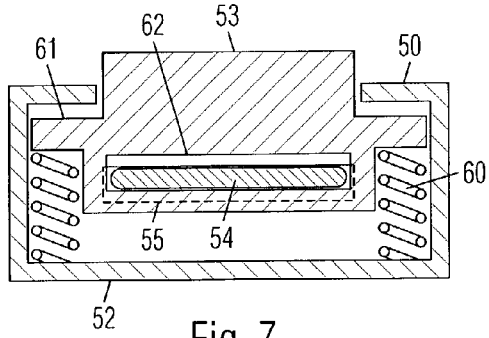
FIG. 7 is a sectional view of the barrel member of the embodiment of FIG. 6.
Figure 8:
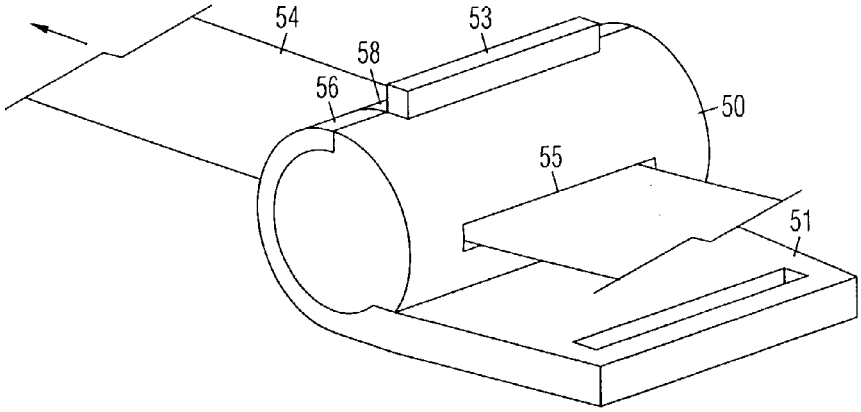
FIG. 8 is a perspective view of the embodiment of FIG. 6 when connected together.

FIGS. 6–8:

A third embodiment of the adjustable strap buckle shown in FIGS. 6–8 is comprised of a barrel member 50 for detachably positioning in a hook member 51. Barrel member 50 is comprised of a tubular housing 52 with a push button 53 projecting from a longitudinal side. In this example, barrel member 50 is cylindrical, but it may be rectangular. A strap 54 is positioned through housing slots 55 (one shown) on opposite sides of housing 52. In this example, strap 54 comprised of flat webbing. Hook member 51 is comprised of side-by-side hooks 56 attached to an anchor member 57. In this example, hooks 56 are curved. A key 58 on outer surface of housing 52 aligns barrel member 50 inside hooks 56 to prevent sliding or rotation. Key 58 is preferably T-shaped as shown, wherein the vertical segment of the "T" is for being positioned between hooks 56, and the transverse segment is for being positioned against the ends of hooks 56. A hole 59 in anchor member 57 enables attachment to another end of strap, another strap, clothing, a bag, luggage, etc. Hole may be of any shape.

As shown in the sectional view in FIG. 7, button 53 is biased outwardly by springs 60 inside housing 52. Springs 60 are positioned under tabs 61 at opposite ends of button 53 on either side of strap 54. Alternatively, a single spring may be positioned under a mid portion of button 53. Strap 54 is positioned through housing slots 55 (one shown) in housing 52 and a button slot 62 in button 53. When button 53 is released as shown, button slot 62 is misaligned with housing slots 55 to bind strap 54. When button 53 is pressed, slots 55 and 62 are all aligned to release strap 54 for sliding through barrel member 50 for adjusting its length.

Barrel member 50 is shown connected to hook member 51 in FIG. 8. The vertical segment of T-shaped key 58 is positioned between hooks 56, and the transverse segment is positioned against the ends of hooks 56. Barrel member 50 is prevented from sliding or rotating. The strap buckle is oriented such that tension in strap 54, as indicated by the arrow, is directed away from the open ends of hooks 56 to maintain barrel member 50 inside hook member 51.

Figure 9:
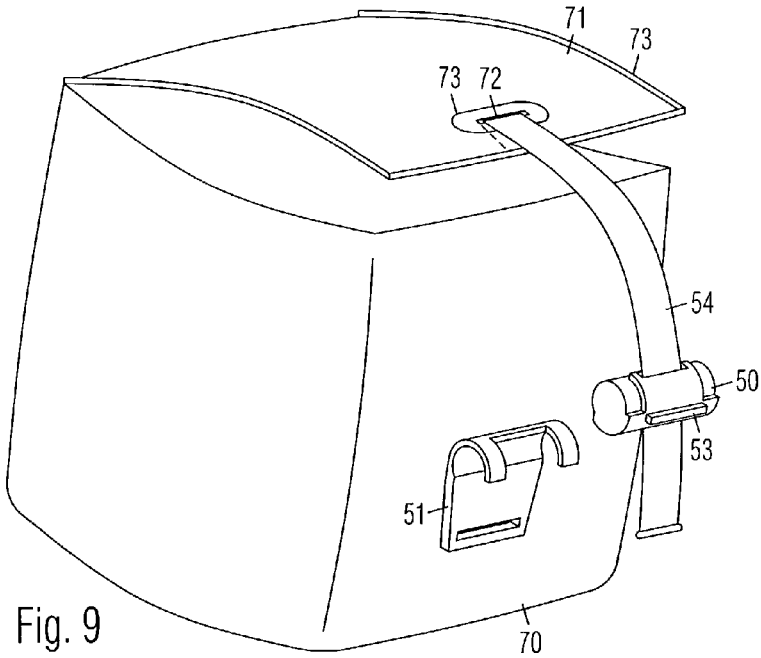
FIG. 9 is a perspective view of the embodiment of FIG. 6 attached to a bag and in a disconnected condition.
Figure 10:
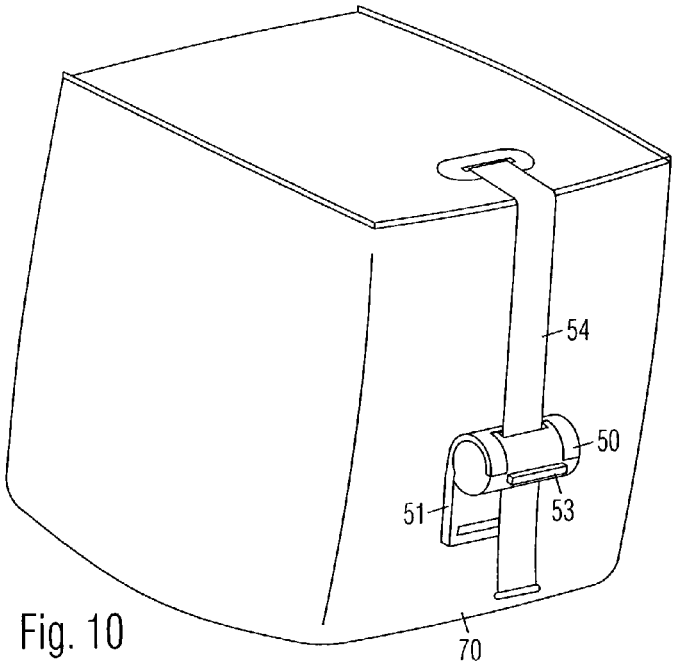
FIG. 10 is a perspective view of the embodiment of FIG. 6 attached to a bag and in connected condition.

FIGS. 9–10:

An exemplar installation of the adjustable strap buckle is shown in FIGS. 9–10. A bag 70 is used in this example, but the buckle may be attached to another article such as a belt, clothing, luggage, etc. Although the third embodiment of the strap buckle is shown, the other embodiments may be installed similarly.

The strap buckle is shown disconnected in FIG. 9. A proximal end of strap 54 is attached to a flap 71 of bag 70. Strap 54 is positioned through a slit 72 on flap 71. Slit 72 is reinforced by an elongated ring 73. The inner end of strap 54 is attached under flap 71, which has an inner liner (not shown) covering the inner portion of strap 54. The edges of flap 71 are reinforced by ribs 73.

Barrel member 50 is shown connected to hook member 51 in FIG. 10 to apply tension on strap 54 and secure flap 71. Strap 54 may be adjusted in length for adjusting tension by pressing button 53, sliding strap 54 through barrel member 50, and releasing button 53 to lock strap 54 in position.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

The invention claimed is:

1. An adjustable strap buckle, comprising:
- an elongated barrel member comprising:
  - an elongated tubular housing;
  - a push button projecting from said housing; and
  - housing holes on opposite walls of said housing for passing a strap transversely through said housing; wherein
  - when said push button is released, said strap is bound inside said barrel member; and
  - when said push button is depressed, said strap is free to slide through said barrel member; and
- a hook member comprising:
  - an anchor member for attaching to an article; and
  - a plurality of spaced apart hooks attached to said anchor member, said hooks having a common axis; wherein
- said barrel member is arranged to be detachably positioned in said hooks generally along said axis of said hooks, and a gap between said hooks is arranged to pass a segment of said strap extending from said barrel member.

2. The adjustable strap buckle of claim 1, wherein said push button projects from an open end of said tubular housing, said button being arranged to slide along an axis of said housing, and further including a button hole positioned through said push button for passing said strap, and a spring assembly biasing said push button outwards, wherein said button hole is misaligned with said housing holes when said button is released, and aligned with said housing holes when said button is depressed.

3. The adjustable strap buckle of claim 1, wherein said push button projects from a longitudinal side of said tubular housing, said button being arranged to slide transversely to an axis of said housing, and further including a button hole positioned through said push button for passing said strap, and a spring assembly biasing said push button outwards, wherein said button hole is misaligned with said housing holes when said button is released, and aligned with said housing holes when said button is depressed.

4. The adjustable strap buckle of claim 1, further including a key on an outer surface of said barrel member, wherein said key is arranged to be positioned between said hooks to prevent said barrel member from sliding.

5. An adjustable strap buckle and bag apparatus, comprising:
- a bag with a flap;
- a strap with a proximal end attached to said flap;
- an elongated barrel member comprising:
  - an elongated tubular housing;
  - a spring loaded push button projecting from said housing; and
  - housing holes on opposite walls of said housing passing said strap transversely through said housing; wherein
  - when said push button is released, said strap is bound inside said barrel member; and
  - when said push button is depressed, said strap is free to slide through said barrel member; and a hook member comprising:

an anchor member attached to a side of said bag;

a plurality of spaced apart hooks attached to said anchor member, said hooks having a common axis; wherein said barrel member is arranged to be detachably positioned in said hooks generally long said axis of said hooks, and a gap between said hooks is arranged to pass a segment of said strap extending from said barrel member.

6. The adjustable strap buckle of claim 5, wherein said push button projects from an open end of said tubular housing, said button being arranged to slide along an axis of said housing, and further including a button hole positioned through said push button for passing said strap, and a spring assembly biasing said push button outwards, wherein said button hole is misaligned with said housing holes when said button is released, and aligned with said housing holes when said button is depressed.

7. The adjustable strap buckle of claim 5, wherein said push button projects from a longitudinal side of said tubular housing, said button being arranged to slide transversely to an axis of said housing, and further including a button hole positioned through said push button for passing said strap, and a spring assembly biasing said push button outwards, wherein said button hole is misaligned with said housing holes when said button is released, and aligned with said housing holes when said button is depressed.

8. The adjustable strap buckle of claim 5, further including a key on an outer surface of said barrel member, wherein said key is arranged to be positioned between said hooks to prevent said barrel member from sliding.

* * * * *